United States Patent [19]

Goodacre et al.

[11] Patent Number: 4,861,382

[45] Date of Patent: Aug. 29, 1989

[54] SUGAR PROCESS

[75] Inventors: Brita C. Goodacre, Sonning; Alan Smithson, Reading, both of England

[73] Assignee: Tate & Lyle PLC, United Kingdom

[21] Appl. No.: 105,510

[22] Filed: Oct. 5, 1987

Related U.S. Application Data

[63] Continuation of Ser. No. 839,365, Mar. 13, 1986, abandoned.

[30] Foreign Application Priority Data

Mar. 13, 1985 [GB] United Kingdom ..... 8506482

[51] Int. Cl.[4] ..... C13F 1/02

[52] U.S. Cl. ..... 127/60; 127/61; 127/63

[58] Field of Search ..... 127/60, 61, 58, 63; 23/301

[56] References Cited

U.S. PATENT DOCUMENTS

| | | | |
|---|---|---|---|
| 3,513,023 | 5/1970 | Kusch et al. | 127/60 |
| 3,883,365 | 5/1975 | Forsberg et al. | 127/61 |
| 3,928,062 | 12/1975 | Yamaych | 127/60 |
| 3,956,009 | 5/1976 | Lyndquist, Jr. et al. | 127/61 |
| 3,981,739 | 9/1976 | Dmitrovsky et al. | 127/60 |
| 4,199,373 | 4/1980 | Dwivedi et al. | 127/60 |
| 4,537,637 | 8/1985 | Hunter et al. | 127/60 |
| 4,666,527 | 5/1987 | Ito et al. | 127/60 |

FOREIGN PATENT DOCUMENTS

| | | |
|---|---|---|
| 1117903 | 6/1968 | United Kingdom . |
| 2133796 | 8/1984 | United Kingdom . |

*Primary Examiner*—H. M. S. Sneed
*Assistant Examiner*—Chung K. Pak
*Attorney, Agent, or Firm*—Ostrolenk, Faber, Gerb & Soffen

[57] ABSTRACT

A continuous process for the crystallization of fructose from an aqueous fructose syrup containing at least 90% by weight fructose on a dry solids basis, in which the syrup at a total solids content of at least 95% by weight is rapidly and thoroughly mixed with seed, at a temperature of 55°-75° e.g for up to 2.5 minutes; is then deposited onto a surface where it is allowed to crystallize under quiescent conditions at a temperature of about 50°-70°, until a solid cake is formed; and is the comminuted to provide a free-flowing granular product which can be further dried.

The process provides a particulate product in the form of crystals in a glossy matrix, in which 95% of the crystals have a particle size of less than 20 microns, the overall degree of crystallinity is greater than 70%, the bulk density is less than 0.65 and which is completely free of organic solvent residues. Other food ingredients may be added simultaneously with the seed.

12 Claims, No Drawings

SUGAR PROCESS

This is a continuation of application Ser. No. 839,365 filed on Mar. 13, 1986, now abandoned.

This invention relates to the crystallisation of fructose to produce a dry, solid product without the use of organic solvents.

Fructose is notoriously difficult to crystallise. Crystallisation of fructose from aqueous systems has tended to involve long crystallisation times, e.g. 100 hours. Anhydrous fructose can also be produced by various other processes, some involving the use of organic solvents such as ethanol.

One commercially used aqueous crystallisation process is disclosed in U.S. Pat. No. 3,883,365 (Forsberg et al.). This involves a two-stage batch process in which both stages operate as constant supersaturation crystallisers being cooled from about 60° C. to about 30° C. over a 50 hour cycle. The first stage grows crystals from seed to an intermediate size. This crystal slurry is transferred to a second larger vessel to which more syrup is added, and over the second cooling crystallisation, crystals are grown up to the product size of 200-600 μm. The crystals are separated from the residual syrup by centrifuge and gently dried at about 40° C. in a vacuum oven.

A disadvantage of processes involving crystallisation from aqueous liquors is that they require syrups to be held at fairly high temperatures for long periods of time. Degradation is a danger in such circumstances and by-products so formed can hinder crystallisation. To minimise this, the maximum operating temperature is kept below 65° C. A further measure disclosed in the above patent is adjusting pH to give slightly acidic conditions (pH 4.5 to 5.5). It is believed that degradation is enhanced by conditions of extreme acidity or alkalinity.

Another disadvantage is the extremely long periods for crystallisation. Plant items are consequently very large for a modest output. It is difficult for high outputs to be practically achieved by this means, although the product (sold under the name Fructofin) is an attractive large crystal fructose.

Total solidification of high brix syrups is an idea that has been applied very successfully to both glucose and sucrose. It is initiated in both cases by applying high shear which causes nucleation. For sucrose under the right conditions the phenomenon of "transformation" occurs where moisture is "boiled off" by the heat of crystallisation, and for glucose, free water is taken up by the formation of the hydrate. In each case, a rapid process results in a product containing a mixture of crystals and amorphous glass. Unfortunately, these ideas do not apply well to fructose syrups where high shear has little effect.

However, such is the desirability for producing solid fructose that fructose solidification processes are of great interest, despite being less versatile than those for glucose and sucrose syrups. A total solidification process for fructose is disclosed in British Pat. No. 1 117 903. In this process, an aqueous fructose solution with a pH of 3.5–8 and a fructose content of at least 95%, referred to the dry matter, is concentrated in a vacuum to a water content of 2–5%, cooled to a temperature of 60°–85° C., seeded with crystalline fructose and stirred vigorously at 60°–85° C. till a kneadable crystalline mass is formed; this crystalline mass is allowed to cool slowly until it solidifies completely, then comminuted and subsequently dried at a temperature below 65° C. to yield a free-flowing finely crystalline powder which is stated to consist almost completely of anhydrous crystalline fructose. The stirring stage of the process takes, typically, 30–50 minutes, during which time the syrup is intensively stirred. The amount of seed added is about 10% by weight. At the end of the stirring stage, a semi-solid crystalline mass is obtained which is kneadable and is typically of the consistency of putty. In a second stage of this process, the putty-like mass can then be kneaded until a completely solidified and crystallised mass is obtained. This mass is then comminuted and ground and can subsequently be dried in a vacuum or with warm air at a temperature of 40°–60° C.

In an apparently continuous of version of the above process, the syrup is dosed into one outlet of a mixer containing a suitable quantity of seed and the almost completely crystallised mass is removed from an opposite outlet at the same rate, after a residence time of about 30 minutes, and is fed to a kneading screw conveyor, formed into thick strands, cooled, ground and dried. It is to be assumed that the seed for subsequent incoming syrup is the residue of the crystalline mass in the mixer.

It will be seen that a process of this type is extremely energy-intensive and very time-consuming. The stirring stage involves at least 30 minutes intensive mixing of the seed with a syrup which progressively becomes more and more viscous until finally it is a pasty, semi-solid kneadable mass. The kneading process is then applied to the putty-like semi-solid for about 2 hours until a "hard but still smeary mass" is formed. Then cooled slowly for about 2 hours until it is completely solidified and then comminuted and dried.

To the best of our knowledge the process of British Pat. No. 1 117 903 has never been used commercially In our attempts to operate this process the product ranged from a sticky glass to a crumbly semi-crystalline material comprising agglomerated crystals in a glassy matrix which reached a crystallinity of 70–80% after drying, depending upon the purity of the starting material.

One successful method of totally solidifying fructose is disclosed in GB No. 2133 796 B, although this is a process which uses an organic solvent. A high Brix fructose syrup is dispersed at very high shear into an alcoholic medium, e.g. ethanol, at a solvent: syrup ratio of less than 0.5 ml/g, allowed to solidify at room temperature and broken into pieces and dried under vacuum to remove most of the solvent. The product is then ground to the required particle size. The product is in the form of particles of agglomerated microcrystals of anhydrous fructose in a glassy matrix with a crystallinity of about 80% and in which 95% the crystals have a maximum dimension of less than 20 microns, the product having a bulk density of less then 0.65 g/ml. The product is rapidly dissolved and is an effective tabletting base, unlike other crystalline fructose products which do not have the required compressibility. The product is also absorbent and can be used as a carrier for oils, fats, flavours etc. However, a drawback of this product is that, in common with other fructose products obtained using organic solvents, it contains organic solvent residues which, in certain circumstances, are undesirable.

There remains a need for a faster method of producing crystalline solid fructose from an aqueous system, without the use of organic solvents and without the need for energy-intensive stirring and kneading, but which can be operated in a continuous manner.

We have now found that it is possible to crystallise a concentrated aqueous fructose syrup in a continuous manner by seeding without the need for prolonged energy-intensive stirring and kneading, by using certain types of mixing apparatus to ensure thorough and rapid dispersal of the seed in the syrup. Furthermore, the product obtained is remarkably similar to that of GB No. 2133 796 B, both in physical form and in the uses to which it may be put, with the exception that it is completely free from organic solvent residues.

According to this invention, we provide a continuous process for the crystallisation of fructose from an aqueous fructose syrup containing at least 90% by weight fructose on a dry solids basis, in which the syrup at a total solids content of at least 95% by weight is rapidly and thoroughly mixed with seed, at a temperature of 55°–75° e.g for up to 2.5 minutes; is then deposited onto a surface where it is allowed to crystallise under quiescent conditions at a temperature of about 50°–70°, until a solid cake is formed; and is then comminuted to provide a free-flowing granular product which may then optionally be ripened further to provide a drier more crystalline product.

A particularly convenient means of rapidly and thoroughly mixing the syrup with the seed is a continuous screw extruder. By the term "continuous screw extruder", we mean a mixing and milling machine of the type having one or more, preferably two, rotating screw members (Archimedean screws) of constant or varied pitch rotating in a close fitting barrel. In these mixers, the incoming material is entrained and compressed in the spaces between the screw blades and the casing and, in the case of a twin screw machine, between the two intermeshing screw blades. The pitches of the two screws may be parallel or opposed, depending on whether the screws co-rotate or counter-rotate, both versions being well known in the plastics milling field. For example, these machines are used to mill PVC before extrusion. Typical machines are produced by Baker Perkins (Saginaw, Mich.) and include the GP, MP and MPF series. Other suppliers of this type of equipment include Teledyne Readco (York, Pa.), Werner & Pfleiderer (Stuttgart) and Creusot (Loire). Machines of this type are further described in Chemical Engineering, March 22nd, 1971 at page 96. Apparatus of this type renders the process easy to run on a continuous basis, and gives mixing times of less than 2 minutes, typically 50–80 seconds.

One preferred type of extruder (Baker Perkins MP 50) has a twin screw system with two side-by-side screws co-rotating and intermeshing in a barrel. The screws each comprise a longitudinal shaft (e.g. with dimensions of 10:1 or 15:1 length:diameter) on which are disposed sections of screw, with a pitch generally equal to or less than the bore diameter of the barrel e.g. of about 25 mm pitch and 50 mm diameter, and sections of unpitched perpendicular "blades" or lens-shaped agitators, arranged to cooperate in pairs, one on each shaft. These blades are generally a pointed oval in shape, centred on the shaft and are for example about 12–13 mm thick and 50 mm in diameter, although a larger machine would, naturally, have larger components. A twin screw system is preferred for various reasons. The heat transfer is better as all the material is continuously moved from the interior between the shafts to the exterior (i.e. The inner barrel surface), thus leading to a more consistent internal temperature. The transport is by positive displacement and does not rely on viscous friction between the blades and barrel and the material. Furthermore, the power is dissipated in many small shear forces rather than in large shear forces, thus aiding the required rapid and thorough dispersion of the seed in the syrup.

A machine of this type operating at a typical rotation speed of 100–200, e.g. 150 rev.min$^{-1}$ can provide a sufficiently rapid, thorough and intimate mixing of the seed and the syrup, in a mean time of less than 20 minutes, eg. about 30 to 90 secs.

It should be noted that although these machines are commonly referred to as 'extruders', the slurry which emerges in the process of this invention is a liquid which is pumped out, not a solid or semi-solid to be extruded in the conventional sense.

Another extruding machine which has been found to be capable of effecting the required rapid and thorough mixing of seed with syrup is the "Rotofeed" (Baker Perkins).

This is a continuous processing machine essentially designed as a blending and slurrying unit for powdered solids and liquids, waxes and light doughs. It is designed to accept a variety of materials, to blend them and discharge them under light pressure for further processing.

The Rotofeed consists of a horizontally mounted, jacketed, conical housing in which rotates a single conical, interrupted-flight screw. An adjustment is provided such that the screw may be moved horizontally relative to the casing to give the facility of adjusting peripheral clearance between the screw and the casing to suit the material being processed. This arrangement, together with variation of screw speed, gives an accurate control on the mixing and dispersion of agglomerates as well as some control on discharge pressure.

The basic machine is available in three standard sizes 178, 356 and 660 mm (7, 14 and 26 in.), these dimensions being the approximate outside diameter of the screw at the feed end. Each machine is constructed as standard with all contact surfaces in stainless steel, the screw normally being driven from a variable speed unit.

Various "Head" units may be fitted to these machines to permit the further processing of materials by one machine. As an example, heads are available for efficient heat transfer to or from the products, for intensive mixing, for aeration or for incorporating of additional ingredients that must be added after the main feed stage, perhaps for process reasons.

We have used a 178 mm Rotofeed. The clearances between the screw rotor and the casing were between 0.25 mm and 0.5 mm (10/1000 and 20/1000 in.). The mixing head consisted of two 76 mm plates with 8 holes of 8 mm diameter in each plate and two impellers. The configurations of these plates was: one plate with the holes, then an impeller, then the other plate with holes, and then the other impeller, and these plates were placed before the discharge port. The plates were stationary, whereas the impellers rotated with the shaft. The diameter of the rotor in the cone was 190.5 mm at the motor end and 38 mm at the discharge end and the core then expanded to accept the plates.

The mixing requirement of the process can be performed in equipment other than extruders/blenders of the types mentioned above but, at present, other commercially-available equipment capable of providing the required degree of mixing with a residence time of less than about two minutes have other limitations such as too large to too small a volume, too little power and unsuitable design for a continuous operation. thus a dough mixer with a single planetary rotor and a bowl of 3 liters capacity (e.g. a "Hobart" laboratory mixer) can be used to mix the seed with the concentrated syrup, but a mixing time of 2.5 to 5 minutes is required to achieve a sufficiently thorough dispersion of the seed in the syrup and the equipment does not lend itself to the development of a continuous system.

At the other extreme, the Kneader described in British Pat. No.1,117,903 with deeply intermeshing paddles that rub against one another as they rotate at 20–40 rev.min$^{-1}$ is incapable of providing the rapid, thorough mixing of the seed with the syrup that is required to initiate crystallisation throughout the mixture and to ensure that further crystallisation will proceed without mixing or kneading, even though it could fairly readily be adapted for continuous operation.

After a relatively short period in the mixer, the seeded syrup is then deposited onto trays or onto a moving band where it is allowed to solidify in a quiescent state while the temperature of the surrounding air is maintained at a level sufficient to keep the crystallising mass at between 50° and 70°. The crystallisation is exothermic and the conditions may need to be controlled so that the crystallising mass does not overheat or cool and vitrify. A temperature of about 60° is optimum.

The speed at which the mixer operates does not appear to be critically important within the range 100 to 300 rev.min$^{-1}$, the speed at which the mixer disperses the seed throughout the syrup being much more important than the development of particular levels of torque or shear, which also depend upon inter alia the flow rate of the syrup into the mixer, the level of seeding and the temperature. By varying these factors, we have operated the process successfully using a mixer speed of 150 rev min$^{-1}$ at torques of from 25 to 75% available power.

The material emerging from the screw extruder is a fairly viscous slurry which, at the temperature concerned, behaves essentially as a liquid, i.e. it is capable of flowing onto a surface such as a moving band and spreading to form a relatively thin layer. The degree of crystallinity of this emerging material, when measured by differential scanning calorimetry, is usually not much more than that provided by the crystalline seed added.

Most surprisingly, crystallisation of the slurry on the moving band requires no kneading, or agitation of any type. After only two to three hours on the band, the solidified fructose can be broken-up and comminuted to give a hard, granular free-flowing product with a degree of crystallinity of over 50%, typically about 60%.

A drier more crystalline product can be obtained by flowing dry air over the granules for several hours and/or by heating the granules in an oven at about 40° C. The crystallinity of such products can be as high as 80–90%, and is typically at least 70%.

The feedstock for the process should be a high fructose syrup, eg. a high fructose corn syrup such as that supplied by Amylum under the Trademark Fructamyl or by Roquette Freres, e.g. a syrup of about 70° Brix and 95% fructose dsb (dry solids basis).

Obviously the starting syrup can be of any available water content, provided that it is concentrated to at lest 95% solids, preferably about 98% solids, by evaporation under reduced pressure before being passed to the mixer. The solids content is important because it provides a good degree of supersaturation. Furthermore, the end product is required to be a relatively dry solid material, so conditions are chosen such that little water remains after the crystallisation is complete. By spreading the crystallising syrup out into a relatively thin layer on a moving conveyor band, e.g a flexible rubber or a steel band, and, if necessary, controlling the ambient temperature around the band, it is possible to control the crystallisation and minimise the degree of glass formation. A typical loading on the band is preferably a layer of from 1 to 10 cm, most preferably about 2 to 6 cm, e.g. about 3 to 4 cm, in thickness. Crystallisation of the solidifying material occurs over two to three hours and the degree of crystallinity can be monitored during the crystallising process.

However, if the solids content of the concentrated syrup exceeds about 98.5% the process appears to be more sensitive to variations in other process conditions, particularly the temperature at which crystallisation takes place, the level of seed in the mixture and, possibly, the level of non-fructose saccharide impurities in the syrup. If the temperature at which the slurry issuing from the mixer is too low in relation to the solids content, the viscosity may be too high too permit rapid crystallisation and a glassy product may result. Thus we have operated the process successfully with solids contents ranging from 97.4 to 99% and averaging 98.1% but we have experienced a number of failures with solids contents of 98.1 to 99.2% (mean 98.6%). Thus in practice it is probably best to avoid using syrups with a solids content of 99% or more and a solids content nearer to 98% will usually be optimal.

The seed crystals used in the process may comprise any relatively small crystals of fructose and, up to a point, the smaller the seed, the faster the crystal growth obtained. We have had good results with seeds ranging from less than 75 microns to 355–600 microns, our most consistently good results being obtained with seed sizes of 75–180 microns or 180–355 microns. The quantity of seed is also important, the process operating most effectively with amounts in excess of 5% of the mixture, e.g. up to 30%, with 10–20% being most convenient and economical.

An advantage of mixers of the type described is that the gradual addition of solid seed material to the syrup through a separate entry port enables the operator to add other food ingredients (especially nonsugars) if it is desired to incorporate them in the crystalline end-product. For example, crystalline fructose containing nuts, bran, cocoa solids, flavourings etc can be produced. In this case, the other products can be combined with the seed, or added through a different port.

The products of this invention can be used in their existing physical form, or the physical form can be modified. For example, the particles can be agglomerated or pelletized.

The present products can be used as a sweetening agent in the same way as conventional solid fructose products. For example, they can be used in baked products, desserts, beverages, jams, chocolate, lowcalorie products, confectionery, diabetic products, brewing, fruit storage, cream icings, and yoghurts.

In addition, the products of this invention can be used in applications for which conventional solid fructose products are not particularly well suited. For example, the products of this invention, like those of GB No. 2,133,796 B, show promise as tabletting materials without the use of a binder such as gum arabic. Exceptionally, the present products can give coherent tablets by direct compression with a lubricant. Special pre-treatments such as moist granulation are not needed.

Thus, the present invention further provides tablets based on a solid diluent which comprises a fructose product of this invention. The tablets can take any of the usual shapes, and suitably contain an active ingredient and one or more additives employed for example to colour the tablets, aid binding, give effervescence, or aid release from a tabletting machine.

Furthermore, the present products can be used as carriers for oils, fats and oil-based flavours. Spraying or other procedures can be used to impregnate the fructose with the oil, fat or flavour.

Another new use for the present solid fructose is as a quick-dissolving sweetener. For example, the fructose can be used in dry pre-mixes for fruit beverages.

Apart from the uses as a sweetener, the present products can also be used as seed crystals for seeding fructose syrups, e.g. in the process of the present invention.

According to a further feature of the present invention, there is provided apparatus for continuously producing crystalline fructose comprising means, including an evaporator, for supplying fructose syrup at the stated temperature and concentration, arranged to supply the syrup to an entry port of a screw extruder, (or another suitable mixing apparatus), means for independently supplying fructose seed crystals to a separate entry port of the extruder, and a conveyor arranged to collect slurry emerging from the extruder and to convey it on a surface at a substantially constant temperature while crystallisation proceeds.

The following examples illustrate the invention further.

EXAMPLE 1

A commercially available high fructose syrup (95% by wt fructose on a dry solids basis) was evaporated under vacuum to approximately 98% solids at 82° C. The syrup was cooled to 65°–69° C. using a scraped surface heat exchanger and then pumped into a Baker-Perkins MP 50 continuous twin screw extruder at a rate of 0.87 kg/min. At the same time, milled crystalline fructose (75–180 microns) was metered into the extruder at a rate of 0.078 kg/min to give a mixture containing 8.2% seed. The well mixed viscous slurry of syrup and seed issuing from the extruder was collected in stainless steel trays and placed in an oven held at 60° C. After two hours, the trays were removed and allowed to cool in ambient conditions for a further two hours. The hard, solid material was broken out of the trays and comminuted to give a hard, granular free flowing product.

EXAMPLE 2

A concentrated syrup was prepared in a similar manner to that in Example 1. The cooled syrup was pumped into the extruder at a rate of 1.01 kg/min. Milled crystalline fructose (75–180 microns) was simultaneously metered into the extruder at a rate of 0.135 kg/min (11.8% seed). The well mixed syrup and seed at a temperature of 69° C. was collected in steel trays and placed in an oven as before. After being held at 60° C. for 2 hours, followed by cooling over 2 hours, the product was comminuted to give a free flowing granular product.

EXAMPLE 3

A high fructose corn syrup was evaporated under vacuum to approximately 96% solids at 82° C. The syrup was cooled to 58° C. and pumped into the extruder at a rate of 1.2 kg/min. Milled crystalline fructose (75–180 microns) was added to the extruder at a rate of 0.078 kg/min (6.1% seed). The product was collected in stainless steel trays and placed in an oven held at 60° C. for 2 hours. After allowing the product to cool in ambient conditions for a further 2 hours, a soft cake was produced. After further standing overnight, a hard product was obtained.

EXAMPLE 4

A commercially available syrup similar to that used in Example 1 was concentrated under similar conditions to 98% solids at 81° C. The syrup was cooled 65°–70° C. and pumped into the extruder at a rate of 0.726 kg/min. Milled crystalline fructose (75–180 microns) was simultaneously added to the extruder at a rate of 0.138 kg/min (16.0% seed). The well mixed syrup and seed emerging from the extruder at a temperature of 70° C. was allowed to fall onto a slow moving conveyor such that the depth of material on the band was 27 mm and the residence time on the band was 2 hours. The solid cake of material at the end of the band was granulated immediately to give a free flowing granular product. This material was found to be 62% crystalline as determined by Differential Scanning Calorimetry.

EXAMPLE 5

A syrup similar to that of Example 4 was concentrated under vacuum to approximately 98% solids. It was subsequently cooled to 65°–70° C. using a scraped surface heat exchanger and pumped into the extruder at a rate of 0.80 kg/min. Milled crystalline fructose (75 to 180 microns) was simultaneously metered into the extruder at a rate of 0.113 kg/min (12.4% seed). The mix of syrup and seed emerging at a temperature of about 69° C. was allowed to fall onto a slow moving conveyor band and the speed of the band adjusted to give a depth of material on the band of 34 mm. The temperature of the material was periodically measured. The crystallinity of the material on the band was also measured. The results are shown in the following table in which the time is the time after extrusion.

| Time (min) | Temperature (°C.) | Crystallinity % |
|---|---|---|
| 0 | 69.0 | about 13 |
| 10 | 69.0 | 18.1 |
| 55 | 75.6 | 37.1 |
| 99 | 72.0 | 51.0 |
| 143 | 62.0 | 56.4 |

Since the degree of crystallinity at time zero was about 13%, and the actual content of seed in the syrup was about 12.4% by weight, it will be seen that virtually no crystallisation had occurred during the seeding and mixing process.

EXAMPLE 6

A syrup similar to that used in Example 1 was concentrated to approximately 98% solids at 85° C. It was then cooled to 65°–70° C. and pumped into the extruder at a rate of 0.72 kg/min. Milled crystalline fructose (75–180 microns) was metered into the extruder at a rate of 0.15 kg/min (17.2% seed). The extruder was operated at a speed of 150 r.p.m. At equilibrium, a solution of concentrated syrup and yellow dye was poured into the extruder. A yellow colouration was first noticed at the discharge end of the extruder after 40 seconds and diminished after 150 seconds, indicating an approximate average residence time of about 90 seconds.

EXAMPLE 7

Some product from a previous experiment was granulated to give a free flowing granular material, conditioned with dry air to remove residual water and further comminuted to give a milled product of 75–180 microns. This was then used as seed in a subsequent experiment. A concentrated syrup prepared as in previous examples was pumped into the extruder at a rate of 0.702 kg/min. The re-cycled milled seed was added to the extruder at a rate of 0.1 kg/min (12.5% seed) and the product allowed to solidify on a slow moving conveyor band. After 188 minutes, a sample was measured to be 54% crystalline.

EXAMPLE 8

A syrup made from fructose and dextrose monohydrate in the ratio of 90:10 fructose : D.M.H. was evaporated under vacuum to 98% solid at 81° C. The syrup was cooled to 70° C. and pumped to an extruder at a rate of 0.795 kg/min. Seed material (75–180 microns) at a rate of 0.139 kg/min (14.9% seed) was simultaneously added to the extruder. The magma of seed and syrup was allowed to solidify on a slow moving conveyor band. After three hours, the material appeared hard and crystalline. The crystallinity as measured by differential scanning calorimetry was found to be 51%.

EXAMPLE 9

A 96:4 fructose: glucose syrup made by dissolving pure crystalline fructose ("Fructofin", Finn Sugar) and pure dextrose monohydrate in water was evaporated under vacuum to approximately 98% solids at 73°–90° C., cooled to 68°–75° C. and pumped into a Baker Perkins MP50 continuous twin-screw extruder (screw shafts 10:1 length:diameter) operating at 150 rev min$^{-1}$, crystalline fructose seed being metered into the extruder simultaneously. The slurry issuing from the extruder as collected in stainless steel trays and placed in an oven held at 60° C. After 2 to 3 hours, the trays were removed from the oven and the hard, solidified material was granulated. The free flowing granular product was dried overnight in a current of dry air at about 40° C. Six separate runs were carried out using different amounts and sizes of seed and the results are shown in the following Table. In the drying step, the water content was found to drop from 2.5% to 1.1% (Karl Fischer).

| Seed size (microns) | Flow Rates (g/min) syrup | seed | % seed mixture | Crystallinity emergent slurry | undried product | dried product |
|---|---|---|---|---|---|---|
| <75+ | 374 | 236 | 39 | 38 | 70 | —** |
| <75+ | 1014 | 240 | 19 | 17 | 53 | 87 |
| 75–180+ | 804 | 154 | 16 | 17 | 52 | 81[a] |
| 180–355+ | 206 | 88 | 30 | 35 | 60 | 78 |
| 355–600+ | 878 | 102 | 10 | 23 | 35 | 78 |
| <600++ | 1003 | 150 | 13 | 17 | 39 | 70 |

*by differential scanning calorimetry
**not determined
+milled fructose crystals
++unmilled fructose crystals
[a]this product was used in Examples 15–18.

EXAMPLE 10

A 97:3 fructose:glucose syrup made by dissolving pure crystalline fructose and pure dextrose monohydrate in water was evaporated under vacuum to approximately 98% solid at 82°–86° C., cooled to 65°–75° C. and pumped into the Baker Perkins MP50 extruder mentioned in Example 9 operating at 150 rev.min$^{-1}$, milled crystalline fructose seed of about 180–355 microns being metered into the extruder simultaneously. The slurry issuing from the extruder was processed as described for Example 9. Five separate runs were carried out using different amounts of seed. The results are shown in the following Table.

| Flow Rates into extruder (g/min) syrup | seed | % seed in mixture | Crystallinity (%) emergent slurry | undried product |
|---|---|---|---|---|
| 605 | nil | nil | 4 | 5 |
| 645 | 35 | 5 | 12 | 26 |
| 847 | 160 | 16 | 23 | 65 |
| 605 | 160 | 21 | 33 | 58 |
| 600 | 250 | 29 | 41 | 65 |

EXAMPLE 11

The procedures of Example 10 were followed with a concentrated (98%) syrup temperature of 59°–69° C., using standard seed size (180–355 microns) and seed quantity (14–18% of mixture) throughout, but varying the operating speed of the extruder in three separate runs at 50, 150 and 300 rev.min$^{-1}$.

The results are shown in the following Table.

| Extruder speed (rev/min/$^{-1}$ | Flow rate into extruder (g/min) Syrup | seed | % seed in mixture | Crystallinity (%) Torque (%**) | emergent slurry | undried product |
|---|---|---|---|---|---|---|
| 50 | 585 | 130 | 18 | 32 | 21 | 28* |
| 150 | 730 | 130 | 15 | 26 | 23 | 59 |

-continued

| Extruder speed (rev/min/$^{-1}$ | Flow rate into extruder (g/min) Syrup | seed | % seed in mixture | Crystallinity (%) Torque (%**) | emergent slurry | undried product |
|---|---|---|---|---|---|---|
| 300 | 808 | 130 | 14 | 24 | 20 | 57 |

*the product eventually reached a crystallinity of 47.5% after standing for three days at room temperature.

**Torque is estimated as % of available power, which is directly related to the operating speed. For comparison, the torque figures at 50 and 300 rev min$^{-1}$ correspond to 10.7 and 48% at 150 rev min$^{-1}$ respectively.

EXAMPLE 12

The procedures of Example 10 were followed with a concentrated (98%) syrup temperature of 66°-68° C., substituting the Baker Perkins "Rotofeed" for the MP50 extruder. The seed size was 180-355 microns and the Rotofeed was operated at 160 rev min$^{-1}$. Two separate runs were carried out with different levels of seeding. The results are presented in the following Table.

| Flow rate into Rotofeed (g/min) syrup | seed | % seed in mixture | Crystallinity (%) emergent slurry | undried product |
|---|---|---|---|---|
| 640 | 80 | 11 | 16 | 53 |
| 450 | 200 | 31 | 35 | 61 |

EXAMPLE 13

Example 11 was repeated, but a yellow dye was fed in with the seed and the time to issue of the most intensely dyed material from the extruder was recorded as a measurement of the residence time. The results were as follows:

| Speed of extruder (rev. min$^{-1}$) | Peak residence time (seconds) |
|---|---|
| 50 | 73 |
| 150 | 44 |
| 300 | 34 |

EXAMPLE 14

Example 12 was repeated with the addition of a yellow dye as in Example 13. The peak residence time, measured in the same way, was 45 seconds at 160 rev.-min$^{-1}$.

EXAMPLE 15

Tablets were produced by direct compression using the following formulation (this and subsequent formulations are in parts by weight):

fructose (Example 9): 98
gum arabic: 1
magnesium stearate: 1

Tablets were also easily obtained using the formulation:

fructose (Example 9): 99
magnesium stearate: 1

Corresponding attempts to form tablets using crystalline fructose (Fructofin) were completely unsuccessful.

EXAMPLE 16

Tablets were produced by direct compression using the following formulation:

fructose (Example 9): 60
ascorbic acid: 10
magnesium stearate: 2
tartrazine colour: qv
IFF orange 17.41.0023 flavour: qv Tablets of good shape and structure each weighing about 700 to 750 mg and containing about 100 mg ascorbic acid (vitamin C) were readily formed.

EXAMPLE 17

A dry-mix beverage was prepared using a solidified fructose from Example 9 on the basis of the following formulation:

ingredient: parts by weight
citric acid monohydrate: 27.1
ascorbic acid: 0.6
sodium citrate: 5.6
orange flavour: 3.2
colouring: 10.5
solidified fructose: 52.8

The beverage for drinking was then prepared by adding water with stirring.

Two comparison pre-mixes were also prepared and used to prepare beverages. Firstly, fructose was crystallized in conventional manner from aqueous solution and used in place of the product of this invention. For the other comparison, the fructose was replaced by sucrose.

The pre-mix of this invention dissolved quicker than the comparison fructose pre-mix and had a better flavour than the sucrose pre-mix.

EXAMPLE 18

20 g totally solidified fructose from Example 9 was stirred in the mixing bowl of a food processor and a mixture of vegetable oil ("Limmitts Spray-and-Fry"), permitted solvent, lecithin and antioxidant was sprayed in to a total of 1.72 g. The product was then stored for 2 days in an air-tight jar. Upon opening of the jar after storage, it was found that the product was still free-flowing.

We claim:

1. A continuous process for the total solidification of fructose comprising the steps of, in the absence of organic solvent, (a) rapidly and thoroughly mixing together aqueous fructose syrup containing at least 90% by weight fructose on a dry solids basis and a total solids content of at least 95% by weight with 5-30 weight % fructose seed crystals, in a screw extruder at a temperature of 55°-75° for up to 2.5 minutes to form a viscous flowable slurry having a degree of crystallinity not much more than provided by the seed; (b) depositing the viscous flowable slurry onto a surface and allowing it to solidify under quiescent conditions at a temperature of about 50°–70°, until a solid cake is formed; and (c) breaking up and comminuting the solid cake to provide a free-flowing granular product having a degree of crystallinity of over 50%.

2. A process according to claim 1, in which the mixing time is up to 2 minutes.

3. A process according to claim 1, in which the syrup has a solids concentration of 95–98.5% by weight.

4. A process according to claim 1, in which the seed is added at a level in excess of 5% by weight.

5. A process according to claim 4, in which the seed is added at a level of 0 to 20% by weight.

6. A process according to claim 1, in which the seed has a particle size range within the range 75 to 355 microns.

7. A process according to claim 1, in which the product is further crystallised by a drying process.

8. A continuous process for the total solidification of fructose from an aqueous fructose syrup which consists essentially of the steps of, in the absence of organic solvent, rapidly and thoroughly mixing together for up to 2.5 minutes an aqueous fructose syrup containing at least 90% by weight fructose on a dry solids basis and a total solids content of at least 95% by weight with 5–30% by weight thereof of fructose seed crystals in a screw extruder at a temperature of 55° to 75° C., to form a viscous flowable slurry having a degree of crystallinity not much more than provided by the seed, depositing the slurry onto a surface and allowing the fructose to crystallize under quiescent conditions at a temperature of about 50° to 70° C. for up to 3 hours until a solid cake is formed, and comminuting the solid cake to provide a free-flowing granular product having a degree of crystallinity of over 50%.

9. The process of claim 8 in which the mixing time is up to 2 minutes, the syrup has a solid concentration of 95 to 98.5% by weight and the seed is added at a level of 10 to 20% by weight.

10. The process of claim 9 wherein the mixing is effected in said screw extruder operated at a rate of 100 to 300 rev.min$^{-1}$ and the mixing time is about 30 to 90 seconds.

11. A process according to claim 10, in which the seed has a particle size range within the range 75 to 355 microns.

12. The process of claim 11, in which the freeflowing granular product is further crystallized by a drying process to a degree of crystallinity of at least 70%.

* * * * *